US005411608A

United States Patent [19]

Hazelton et al.

[11] Patent Number: 5,411,608

[45] Date of Patent: May 2, 1995

[54] PERFORMANCE LIGHT RARE EARTH, IRON, AND BORON MAGNETIC ALLOYS

[75] Inventors: Robert Hazelton, Christiansburg, Va.; George Hadjipanayis, Manhattan, Kans.

[73] Assignee: Kollmorgen Corp., Dallas, Tex.

[21] Appl. No.: 158,473

[22] Filed: Nov. 29, 1993

Related U.S. Application Data

[63] Continuation of Ser. No. 902,403, Jun. 19, 1992, abandoned, which is a continuation of Ser. No. 391,722, Aug. 8, 1990, abandoned, which is a continuation of Ser. No. 936,832, Dec. 2, 1986, abandoned, which is a continuation of Ser. No. 569,470, Jan. 9, 1984, abandoned.

[51] Int. Cl.[6] ..... H01F 1/053

[52] U.S. Cl. ..... 148/302; 420/83; 420/121

[58] Field of Search ..... 148/302; 402/83, 121

[56] References Cited

U.S. PATENT DOCUMENTS

| | | | |
|---|---|---|---|
| 4,402,770 | 9/1983 | Koon | 148/302 |
| 4,533,408 | 8/1985 | Koon | 148/103 |
| 4,597,938 | 7/1986 | Matsuura et al. | 419/23 |
| 4,601,875 | 7/1986 | Yamamoto et al. | 419/23 |
| 4,767,474 | 8/1988 | Fujimura et al. | 148/302 |
| 4,792,368 | 12/1988 | Sagawa et al. | 148/302 |
| 4,802,931 | 2/1989 | Croat | 148/302 |
| 4,851,058 | 7/1989 | Croat | 148/302 |

FOREIGN PATENT DOCUMENTS

| | | | |
|---|---|---|---|
| 0046075 | 2/1982 | European Pat. Off. . | |
| 55-113304 | 9/1980 | Japan . | |
| 56-47538 | 4/1981 | Japan . | |
| 57-141901 | 9/1982 | Japan . | |
| 420695 | 9/1974 | U.S.S.R. | 148/101 |

OTHER PUBLICATIONS

A Dictionary of Metallurgy, A. D. Merriman, 1958 p. 190.

Hackh's Chemical Dictionary, Julius Grant, 1969 p. 432.

The Condensed Chemical Dictionary 8th ed, Gessner G. Hawley, p. 589, 1971.

Rostoker et al, "A Study Aid for Introductory Courses in Materials Science and Engineering," Stipea Pub. Co. 1974, p. 129.

Reed-Hill, "Physical Metallurgy Principles" 2nd ed. 1973 pp. 313-314.

Metals Handbook, 9th ed., vol. 7, 1984 pp. 311-312.

*Primary Examiner*—George Wyszomierski

*Attorney, Agent, or Firm*—Morgan & Finnegan

[57] ABSTRACT

This invention relates to improved performance light rare earth, iron and boron magnetic alloys containing a small amount of cobalt.

12 Claims, No Drawings

PERFORMANCE LIGHT RARE EARTH, IRON, AND BORON MAGNETIC ALLOYS

This application is a continuation of U.S. Ser. No. 07/902,403, filed Jun. 19, 1992, which is a continuation of Ser. No. 07/391,722, filed Aug. 8, 1990, which is a continuation of Ser. No. 06/936,832, filed Dec. 2, 1986, which is a continuation of Ser. No. 06/569,470, filed Jan. 9, 1984, all abandoned.

This invention relates to novel compositions for permanent magnet alloys, and more particularly, to permanent magnet alloys which contain light rare-earth elements, certain easily obtained and readily available elements and a minimal amount of cobalt.

BACKGROUND OF THE INVENTION

Permanent magnets made of various metallic and metallic/rare earth alloys are well known. For example, aluminum-nickel-cobalt (AlNiCo) and samarium-cobalt alloys are used in making permanent magnets. Both AlNiCo magnets and samarium-cobalt magnets contain a high percentage of cobalt. In general, AlNiCo magnets contain more than 25% cobalt; samarium-cobalt magnets generally contain at least 25% cobalt and can contain much more. Cobalt, however, has become expensive and difficult to obtain. Cobalt deposits are not located in the United States or other nations with which the United States trades on a regular basis.

Hard magnetic materials comprising only rare earth elements and iron have been studied. However, only terbium-iron alloys show good hard magnetic properties in the amorphous and crystallized states. For example, gadolinium-iron, and yttrium-iron alloys have also been studied but do not show good hard magnetic properties. (See "Anomolous Magnetization of Amorphous $TbFe_2$, $GdFe_2$, and $YFe_2$", J. J. Rhyne, 10 Physical Review B, No. 11, December, 1974). Other rare-earth iron alloys are also known for their hard magnetic properties. For example, one iron-boron-rare earth magnetic alloy is $$(Fe_xB_{1-x})_{0.9}\,Tb_{0.05}\,La_{0.05}$$

(Koon, et al., the "Composition Dependency of Coersive Force and Microstructure of Crystallized Amorphous $(Fe_xB_{1-x})_{0.9}\,Tb_{0.05}\,La_{0.05}$ Alloys", IEEE Transaction on Magnetics MAG-18, No. 6, November, 1982 and Becker, "Surface Effects in Hysteresis Loop Shapes in High-Coercive Force Crystallized Amorphous Alloys" IEEE Transactions on Magnetics, MAG-18, No. 6, November, 1982). However, these alloys have a relatively low energy product (four to eight megagauss-Oersteds), indicating inferior hard magnetic properties. Permanent magnets made primarily of alloys of more abundant, inexpensive and non-strategic rare earth elements are desirable.

One such light rare-earth element is praseodymium. However, certain alloys which contain only praseodymium and iron have been found to have hard magnetic properties below the standards for economic viability (see, J. J. Croat "Permanent Magnet Properties of Rapidly-Quenched Rare Earth-Iron Alloys", presented at Third Joint Intermag-Magnetism and Magnetic Material Conference, Montreal, Quebec, Canada, 1982).

Neodymium is another rare earth element which is used in magnetic alloy materials. Magnetic alloys composed of neodymium, iron, and boron have been developed. Other types of alloys which do not contain cobalt have been developed. U.S. patent application Ser. No. 076,067, for example, describes certain light rare-earth, iron, boron and silicon alloys having excellent hard magnetic properties. However, it has been found that some magnetic alloys comprising neodymium, iron and boron tend to become demagnetized in an irreversible fashion when subjected to high operating temperatures, e.g., above 130° C. It is expected that the Curie temperature of these materials, or the temperature at which all ferromagnetic properties disappear, would be in the range of 300°–350° C. A material having a Curie temperature in this range is unacceptable for use in standard industrial motors.

BRIEF SUMMARY OF THE INVENTION

An alloy has now been made which has excellent permanent hard magnetic properties (high coercivity and high induction levels), and which also has a high Curie temperature. More particularly, the addition of a small amount of cobalt, in an amount which does not appear to significantly affect the hard magnetic properties, to light rare earth-iron-boron-silicon alloys unexpectedly improve the temperature-characteristics of the alloys. Alloys having an approximate chemical composition of $$Fe_{100-x-y-z}\,R_xCo_y\,(BSi)_z$$

wherein R is one or more light rare earth metals, x is from about 12 to about 40, y is from about 4 to about 10 and z is from about 3 to about 8, have excellent hard magnetic properties and remain magnetized throughout broad temperature ranges. The alloys of this invention are prepared by arc-melting the elements, rapid-quenching the product and heat treating it.

DETAILED DESCRIPTION OF THE PREFERRED EMBODIMENT

The present invention is a permanent magnet alloy containing one or more light rare earth elements (R), iron (Fe), cobalt (Co), boron (B), and silicon (Si) having an approximate chemical composition of $$Fe_{100-x-y-z}R_xCo_y(BSi)_z$$

wherein R represents one or more rare earth elements selected from the group consisting of, praeseodymium, terbium and neodymium, x is from about 12 to about 40, and y is from about 4 to about 10, and z is from about 3 to about 8. R is preferably selected from the group of praesodymium and neodymium. Mischmetal is well-known by those of ordinary skill in the art to be a combination of rare earth elements such as cerium, lanthanum, praseodymium, neodymium, didmium, and the like (See, e.g. *Hackh's Chemical Dictionary, 4th Edition*, and McGraw-Hill, Inc., 1969 and *Concise Chemical and Technical Dictionary*, Chemical Publishing Company, Inc., 1947.

It is believed that the alloys of this invention will maintain their excellent hard magnetic and temperature characteristics with the addition of cobalt up to the point at which the cobalt affects the magnetic properties of the alloy. Preferably, the cobalt should be in the range of from between 4 and 10 atomic percent in order to maintain good hard magnetic properties. It is believed that even very small amounts (e.g. less than 4 atomic percent) of cobalt would raise the Curie temperature significantly. It is expected, however, that the preferable range is between 4 and 10 atomic percent.

The permanent magnets of this invention may have an intrinsic coercive field, or $H_{ci}$, of from about 5 to above 40 kilo-oersteds (kOe) an energy product, $(BH)_{max}$, of from about 3 to about 11 megagauss-oersteds (MGOe), and a Curie temperature of above 400° C. The embodiments of this invention containing both terbium and another light, rare earth, for example praseodymium, can have an extraordinarily high $H_{ci}$ of more than 40 koe.

The intrinsic coercive field $H_{ci}$, is the "reverse field", or the strength of field required to demagnetize the material once magnetized. $H_{ci}$ may be measured on a magnetization vs. field strength hysteresis loop at the point at which the loop crosses the H, or field strength-axis, i.e., where the M, or magnetization value is zero. B, the flux density, is equal to the field strength, H, plus the magnetization value M, multiplied by $4\pi$. The energy product $BH_{max}$ is the absolute value of the largest product of the flux density value and the field strength value of the hysteresis loop measuring the magnet. A high B-value reflects a material which can produce a high magnetic flux density. A high $H_c$-value reflects a material which is difficult to demagnetize. Thus, a loop with a high $BH_{max}$ or energy product, describes a very powerful magnet. The alloys of this invention are expected to have good hard magnetic properties throughout the composition ranges given for x, y and z.

The permanent magnets of this invention can be made by arc-melting the component elements at a temperature sufficient to melt the elements, rapid-quenching the product of the arc-melting step and then heat-treating the resulting product at least once in a non-oxidizing atmosphere such as in a vacuum or an inert gas oven at a temperature from about 550° C. to about 800° C.

The permanent magnets of this invention can be made by arc-melting the elements intended to be components of the alloys, (e.g., the light rare earth element, iron, cobalt, boron and silicon) in elemental or conglomerate form. The arc is electrically induced. It is produced by a current of about 150 amperes. The arc-melting should last for a length of time sufficient to melt the elements (about 15 to about 20 seconds) in an argon atmosphere at atmospheric pressure.

The sample should then be sealed under vacuum in a quartz, crucible and may be homogenized. Homogenization should take place in a furnace at about 950° C. to about 1050° C. for a period of time from about 2 to about 5 hours. Homogenization may also be accomplished during arc-melting by subjecting the material to additional arc-melting.

After arc-melting and homogenization, the alloy should be rapid-quenched in a manner known to those having ordinary skill in the art. Rapid-quenching allows the alloy to attain as amorphous a structure as possible. One method for rapid quenching is melt-spinning.

The melt-spinner may have a beryllium-copper wheel which spins at a rate of about 5,000 rpm. The quartz crucible containing the product is oriented in the direction of wheel rotation. The quartz crucible should have an orifice with a diameter of about 0.5–1.0 millimeters situated from about 2 millimeters to one centimeter from the wheel surface. There should be a pressure of about 15 psi of argon in the crucible. The product flows out of the orifice onto the wheel and is rapidly quenched when it contacts the wheel. The product of this step, ribbons of alloy, is then heat-treated at least once in a vacuum or in an inert gas oven at about 550° C. to about 800° C. for approximately 15 to about 90 minutes in total. At higher temeratures, less time is required for heat treatment.

Another rapid-quenching method is splat-cooling. In this method, the molten alloy is placed on the head of a copper piston. Another piston is quickly dropped against the first piston and the splattered rapidly-quenched material collected.

The heat treatment produces a highly anisotropic phase with a Curie temperature of above 400° C. The Curie temperature of these alloys is approximately at least 100° C. higher than that of similar alloys not containing cobalt. The high energy product magnetic alloys of this invention have a distinct tetragonal crystal structure and a particular stable hard magnetic phase referred to as $R_2(Fe,Co)_{14}B_1$ phase. The inclusion of boron in suitable amounts promotes formation of the phase. Iron is necessary to form the new boron-containing magnetic phase. The most preferred alloys contain the light rare earth elements neodymium and/or praseodymium.

The following non-limiting example illustrates the process of making alloys of this invention.

EXAMPLE 1

0.94 g of praseodymium, 0.56 iron, 0.75 g Allied Metglas having a composition of $Fe_{67}Co_{18}B_{14}Si_1$, was melted in an arc furnace in an argon atmosphere at a temperature sufficient to melt them and at a pressure of one atmosphere for 15 to 20 seconds. 2.25 grams of product were produced by the arc melting. This was remelted 4–5 times. This product was homogenized during the process of arc-melting. The product was then melt-spun at 5,000 rpm (surface speed of approximately 47 m/sec). A 11.6 milligram sample of the melt-spun material in the form of amorphous flakes was then heat treated at a temperature of 550° C. for 30 minutes and 650° C. for 1 hour. The resultant product had a composition of $Pr_{26.8}Fe_{62.3}Co_{6.0}B_{4.6}Si_{0.3}$. The heat treated product had a Curie temperature of about 420° C.–450° C., a $H_{ci}$ of about 5 kOe, and a $BH_{max}$ of about 3.7 MgOe.

EXAMPLE 2

0.27 gram of praeseodymium, 0.3 gram terbium, and 0.43 gram iron were melted together in an arc-furnace and homogenized to produce an alloy. 0.71 gram of this material were melted together with 0.36 g Metglas, arc-melted and homogenized to produce an alloy having the approximate composition of $Pr_{11}Tb_{11}Fe_{67}Co_6B_{4.7}Si_{0.3}$. The arc-melted and homogenized product was then melt-spun to produce amorphous flakes. The flakes were heat-treated for 30 minutes at 550° C. in an argon atomosphere. The heat-treated product had an estimated $H_{ci}$ of approximately 40 KOe, a Br of 3.2 kG and a $BH_{max}$ of 2.5 MGOe.

EXAMPLE 3

Aproximately 0.3 g of neodymium, 0.05 g of boron, 1.01 g of silicon, 0.5 g of iron and 0.2 g of cobalt should be arc-melted in an arc-furnace at a pressure of about one atmosphere for 15 to 20 seconds. The product should then be homogenized for about 3–5 hours at a temperature of about 1000° C. to produce an alloy having the approximate composition $ND_{10.7}Fe_{46.2}Co_{17.5}B_{23.8}Si_{1.8}$. The homogenized product should be melt-spun into amorphous flakes. The amorphous flakes are to be heat-treated for about 30 minutes at 700° C. in an argon atomsphere. It is expected that the product would have a Curie temperature above 400° C., a $H_{ci}$ of about 5–20 KOe and a $BH_{max}$ of about 3–11 MGOE.

What is claimed is:

1. A permanent magnetic alloy containing a 2:14:1 rare earth:iron:boron phase and consisting essentially of 12 to 40 atomic % of a light rare earth selected from the group consisting of praseodymium, neodymium and mixtures thereof, an effective amount up to about 10 atomic % of Co to increase the Curie temperature of said alloy, about 3 to about 8 atomic % boron, and the balance iron.

2. The alloy of claim 1, wherein the light rare earth element is praseodymium.

3. The alloy of claim 1, wherein the effective amount of cobalt is about 2 atomic %.

4. The alloy of claim 1, where the light rare earth element is praseodymium and cobalt is present in an amount of about 4 to about 10 atomic %.

5. The alloy of claim 1, where the light rare earth element is neodymium.

6. The alloy of claim 1, wherein cobalt is present in an amount of about 4 to about 10 atomic %.

7. A permanent magnetic alloy consisting essentially of about 12 to about 40 atomic % of one or more light rare earth elements selected from the group consisting of praseodymium, neodymium and mixtures thereof, about 3 to about 8 atomic % boron, an effective amount up to about 10 atomic % cobalt, and the balance iron, wherein the cobalt increases the Curie temperature of the alloy.

8. The alloy of claim 7, wherein the light rare earth element is praseodymium.

9. The alloy of claim 7, wherein the light rare earth element is neodymium.

10. The alloy of claim 7, wherein the light rare earth elements are praseodymium and neodymium.

11. The alloy of claim 10, wherein the cobalt is present in an amount of about 4 to about 10 atomic %.

12. A permanent magnetic alloy having a chemical composition consisting essentially of: $Fe_{100-x-y-z}R_xCo_yB_z$, wherein Fe is iron, R is a light rare earth selected from the group consisting of praseodymium, neodymium and mixtures thereof, Co is cobalt, B is boron, and x, y, and z represent atomic percentages, wherein x is between about 12 and about 40, y is an effective amount up to about 10 to increase the Curie temperature of said alloy, and z is about 3 to about 8.

* * * * *